US011569587B1

(12) United States Patent
McCarrick

(10) Patent No.: US 11,569,587 B1
(45) Date of Patent: Jan. 31, 2023

(54) HEMISPHERICAL ARRAY ANTENNA

(71) Applicant: Micro-Ant, LLC, Jacksonville, FL (US)

(72) Inventor: Charles McCarrick, Jacksonville, FL (US)

(73) Assignee: MICRO-ANT, LLC, Jacksonville, FL (US)

( * ) Notice: Subject to any disclaimer, the term of this patent is extended or adjusted under 35 U.S.C. 154(b) by 38 days.

(21) Appl. No.: 17/447,678

(22) Filed: Sep. 14, 2021

(51) Int. Cl.
*H01Q 21/20* (2006.01)
*H01Q 21/06* (2006.01)

(52) U.S. Cl.
CPC ..... *H01Q 21/205* (2013.01); *H01Q 21/065* (2013.01)

(58) Field of Classification Search
CPC ..... H01Q 21/205; H01Q 21/06
See application file for complete search history.

(56) References Cited

U.S. PATENT DOCUMENTS

| | | | |
|---|---|---|---|
| 4,792,808 | A | 12/1988 | Hildebrand |
| 5,552,798 | A | 9/1996 | Dietrich et al. |
| 5,642,122 | A | 6/1997 | Lockie et al. |
| 5,650,788 | A | 7/1997 | Jha |
| 5,764,192 | A | 6/1998 | Fowler et al. |
| 5,995,062 | A | 11/1999 | Denney et al. |
| 6,049,305 | A | 4/2000 | Tassoudji et al. |
| 6,295,035 | B1 | 9/2001 | Holzheimer |
| 6,608,595 | B1 | 8/2003 | Louzir |
| 7,315,239 | B2 | 1/2008 | Cheng et al. |
| 8,159,394 | B2 | 4/2012 | Hayes et al. |
| 8,976,066 | B2 | 3/2015 | Manasson et al. |
| 9,170,348 | B2 | 10/2015 | Abbaspour-Tamijani et al. |
| 9,225,073 | B2 | 12/2015 | Culkin et al. |
| 9,640,875 | B2 | 5/2017 | Wilkinson et al. |
| 9,653,816 | B2 | 5/2017 | Ferreri et al. |
| 9,696,419 | B2 | 7/2017 | Mitchel |
| 9,810,774 | B2 | 11/2017 | Wittenberg |
| 9,927,807 | B1 | 3/2018 | Ganjoo |
| 10,965,039 | B1 | 3/2021 | Chandler et al. |
| 2001/0050634 | A1 | 12/2001 | Laidig et al. |
| 2012/0235858 | A1 | 9/2012 | Dougherty et al. |

(Continued)

OTHER PUBLICATIONS

I. Khalifa and R. Vaughan, "Optimal Configuration of Multi-Faceted Phased Arrays for Wide Angle Coverage," 2007 IEEE 65th Vehicular Technology Conference—VTC2007—Spring, 2007, pp. 304-308, doi: 10.1109/VETECS.2007.74.

(Continued)

*Primary Examiner* — Dieu Hien T Duong
(74) *Attorney, Agent, or Firm* — Mark Young, P.A.

(57) ABSTRACT

A multibeam hemispherical X-band array inserts nulls at horizontal and near horizontal angles to suppress interfering signals, without degrading authentic signals arriving at other angles. The multibeam hemispherical array includes three annular (360) rows of antenna elements, each row having 64 elements. Elements of the first row, which have the smallest elevation angle, have pairs of circular patches coupled with a phase delay line. Each pair of circular patches is spaced apart from and aligned with two pairs of similarly shaped (circular) and sized parasitic directors. The spacing between driven patches of adjacent elements in a row is about equal to one half of the wavelength of the radiated wave. The array fits within a conventional 24-inch diameter marine radome.

20 Claims, 6 Drawing Sheets

(56) References Cited

U.S. PATENT DOCUMENTS

| | | | |
|---|---|---|---|
| 2013/0314280 | A1 | 11/2013 | Maltsev et al. |
| 2015/0215011 | A1 | 7/2015 | Hartenstein et al. |
| 2016/0282462 | A1 | 9/2016 | Pitts et al. |
| 2018/0227928 | A1 | 8/2018 | Kim et al. |

OTHER PUBLICATIONS

J. R. Lambert, C. A. Balanis and D. DeCarlo, "Spherical cap CRPAs for GPS," 2008 IEEE Antennas and Propagation Society International Symposium, 2008, pp. 1-4, doi: 10.1109/APS.2008.4619967.

HEMISPHERICAL ARRAY ANTENNA

FIELD OF THE INVENTION

This invention relates generally to antennas, and, more particularly, to a hemispherical x-band array configured to insert nulls at horizontal and near horizontal angles to suppress interfering signals, without degrading authentic signals arriving at other angles.

BACKGROUND OF THE INVENTION

Multi-beam hemispherical arrays suitable for fleet command and control communications with secondary radar functionality are known. A nonlimiting example of such an array is disclosed in U.S. Pat. No. 10,965,039 (Chandler et al.). Charles McCarrick of Micro-Ant, LLC, first conceived and reduced to practice the antenna array described in Chandler et al. Without conveying any intellectual property rights, McCarrick disclosed the array to representatives of Lockheed Martin Corporation. Lockheed Martin Corporation then applied for patent protection on systems and methods that include Micro-Ant's array. The entire disclosure of Chandler et al. is incorporated herein and made a part hereof by this reference.

The array described by Chandler is susceptible to error, particularly from transmissions and receptions from elements at the bottom row of the array, i.e., the row nearest the base. Elements in the bottom row are oriented at the smallest elevation angle, i.e., the angle relative to vertical, or relative to a normal line extending from the base. Elements in the bottom row of the array in Chandler et al. are configured to transmit and receive signals at and near the azimuth, but not configured to mitigate interference from the horizon.

Transmitted and received signals are subject to degradation by several factors, including, inter alia, signal multipath which occurs when a signal reflects off of objects such as vehicles, buildings or other structures before reaching a receiver or target. A location of a mobile object, such as a drone, other aircraft, a missile and the like that is determined from a signal reflected off of ground-based objects will be erroneous. A transmitted signal reflected off of such objects may not reach an intended target.

A hemispherical array that is suitable for fleet command and control communications with secondary radar functionality, and mitigates interference from the horizon is needed. The invention is directed to overcoming one or more of the problems and solving one or more of the needs as set forth above.

SUMMARY OF THE INVENTION

To solve one or more of the problems set forth above, in an exemplary implementation of the invention, a multibeam hemispherical array according to principles of the invention inserts nulls at horizontal and near horizontal angles to suppress interfering signals, without degrading authentic signals arriving at other angles. The multibeam hemispherical array includes three annular (360) rows of antenna elements. Each annular row includes 64 evenly spaced elements (i.e., evenly spaced within their row). Each annular row includes a constant latitude of antenna elements and is parallel to the other rows. The rows include a first row, a second row and a third row, with the second row disposed between the first row and the third row. The first row has a first diameter that is greater than the diameter of the second row, which is greater than the diameter of the third row.

Dimensions and spacings affect the performance. The single driven circular patch of each antenna element of the second row is spaced apart from each adjacent single driven circular patch of each adjacent antenna element of the second row by a distance of about one half a wavelength of a wave radiated from the single driven circular patch. The distance is measured from a center of each single driven circular patch to a center of each adjacent single driven circular patch. The same applies for spacing between patches of adjacent elements in the third row, i.e., the spacing is about one half a wavelength of a wave radiated from an element of the third row, measured from patch center to patch center. Likewise, the distance between patches of adjacent elements of the first row is about one half a wavelength of a wave radiated from the driven circular patches. Again, such distance is measured from patch center to patch center.

The diameter of each driven circular patch of each antenna element of the first row, second row and third row is 1 to 1.5 cm, e.g., about 1.20 cm. Patch diameter influences the resonant frequency, input impedance and radiation pattern.

A phase delay line couples the pair of driven circular patches of each antenna element of the first row. The patches are separated by a separation distance that is less than one half of a wavelength of a wave radiated from each patch of the pair. The phase delay line may have a length that is about equal to one half of a wavelength of a wave radiated from each patch of the pair of driven circular patches.

The elevation angle is the angle measured relative to a normal axis extending orthogonally from a planar base supporting the array. If the base is horizontal, the normal is vertical. The elevation angle of each antenna element of the first row is about 10 degrees. The elevation angle of each antenna element of the second row is about 35 degrees. The elevation angle of each antenna element of the third row is about 60 degrees.

Each antenna element of the second row and the third row includes a single driven circular patch, while each antenna element of the first row includes a pair of coupled driven circular patches. Each antenna element of the second row and the third row also includes an intermediate circular parasitic director spaced apart from and aligned with the single driven circular patch. Each antenna element of the first row includes an intermediate pair of circular parasitic directors spaced apart from and aligned with the pair of driven circular patches. Each antenna element of the second row and the third row also includes an outer circular parasitic director spaced apart from and aligned with the single driven circular patch. The intermediate circular parasitic director is disposed between the single driven circular patch and the outer circular parasitic director. Each antenna element of the first row includes an outer pair of circular parasitic directors spaced apart from and aligned with the pair of driven circular patches. The intermediate pair of circular parasitic directors is disposed between the pair of driven circular patches and the outer pair of circular parasitic directors.

Spacers separate the intermediate parasitic directors from the aligned driven patches, and the outer parasitic directors from the intermediate parasitic directors. Each spacer is a dielectric closed cell foam sheet. The thickness of each spacer is about ⅛ inch (+/−12%).

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An array according to principles of the invention includes elements or small antennas. The elements are interfaces between electromagnetic waves propagating through space and electric currents moving in metal conductors. Each antenna element acts in both transmit and receive modes. In transmission, a power amplifier supplies an electric current to the element, and the element radiates the energy from the current as electromagnetic waves. In reception, the element intercepts some power of an electromagnetic wave to produce an electric current at its terminals, that is applied to a low noise amplifier. A transmit/receive (T/R) module may combine power amplification and low noise amplification in one package. A T/R module may have phase and amplitude controls to steer a beam, calibrate a signal path, and control sidelobes. A beamforming network takes signals from elements and coherently combines them to form a beam in receive mode. In the transmit mode, a feed network distributes a signal from a transmitter to the elements to form a beam.

The present invention relates to the array of elements. The arrangement and configuration of elements described herein overcomes problems, to which the array described in Chandler et al. is vulnerable.

Figure 1:
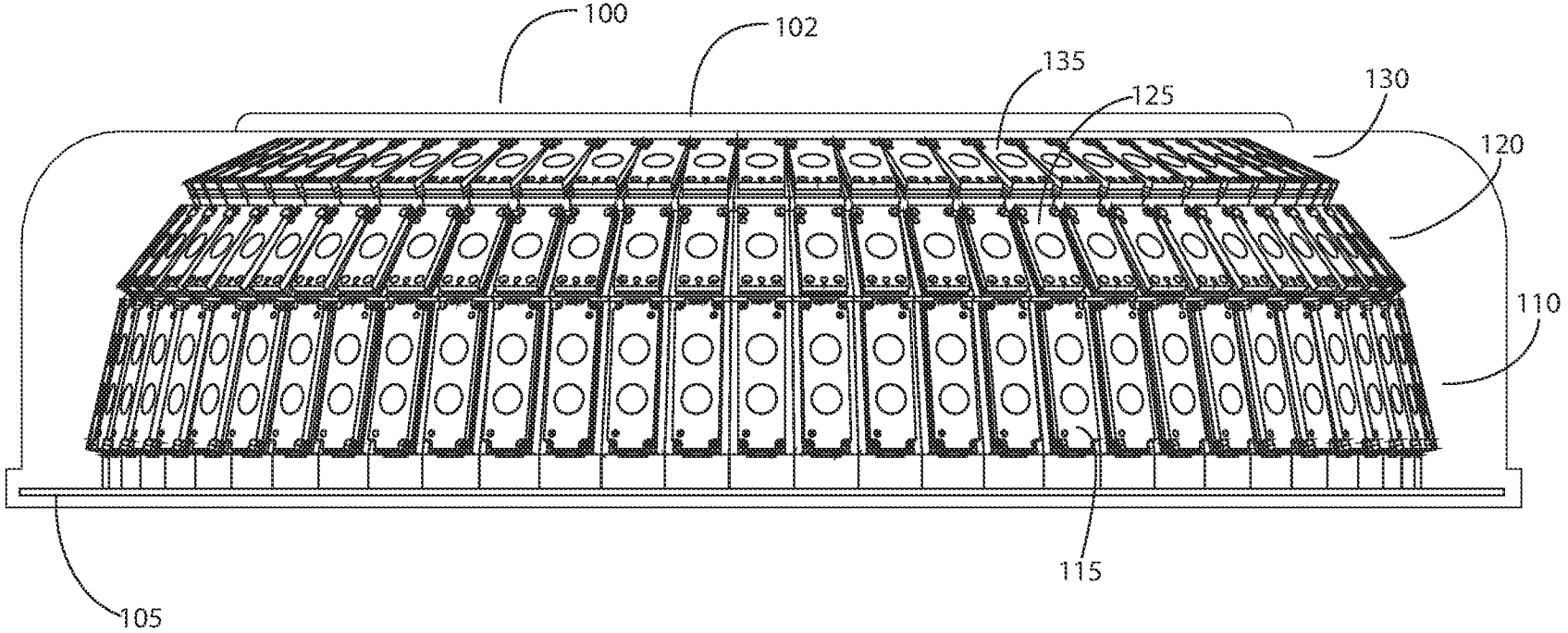
FIG. 1 is a side view of an exemplary hemispherical array according to principles of the invention.
Figure 2:
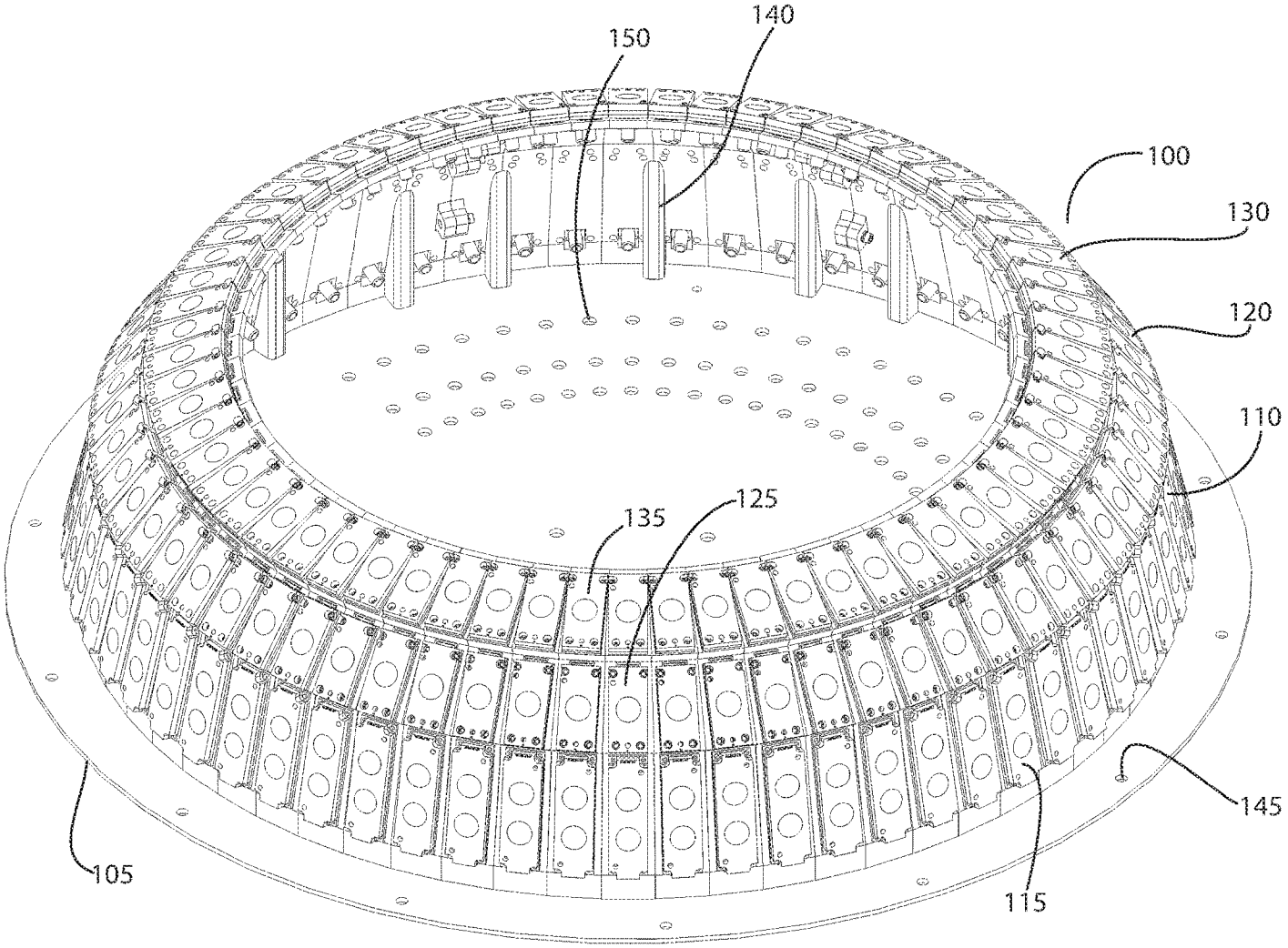
FIG. 2 is a top perspective view of the exemplary hemispherical array according to principles of the invention.

With reference to FIGS. 1 and 2, elements of a hemispherical array 100 according to principles of the invention are arranged in annular lines of constant latitude, or parallels, that extend in generally circular paths parallel to the base 105. Each line of latitude that contains elements is referred to herein as a row. The exemplary hemispherical array 100 includes three rows 110, 120, 130. However, the invention is not limited to an array with three rows.

For identification purposes, each row is given a name, here a number designation. The array could be oriented as shown in the drawings, or mounted in a different orientation, such as, but not limited to, an orientation opposite to the orientation shown in figures. For example, the array may be mounted to the bottom, front, back or side of an aircraft, spacecraft or satellite. To avoid confusion, the row 110 closest to the base 105, the bottom row in FIG. 1, is referred to herein as the first row or row 1. The next row 120, which is the intermediate or middle row, is referred to herein as the second row or row 2. The next row, the row with the smallest diameter 130, the top row in FIG. 1, is the third row or row 3. Row 2 is between rows 1 and 3. Row 1 is closest to the base 105. Row 3 is farthest from the base 105.

In FIG. 1, a radome 102 is conceptually illustrated. The radome 102 is a structural, weatherproof enclosure that protects the contained array. The radome 102 is constructed of material that minimally attenuates the electromagnetic signals transmitted and received by the elements. Of significance, the array 100 described herein may be, and in the exemplary embodiment is, configured to fit within a conventional 24-inch diameter marine radome.

A shown in FIG. 2, the shape of the array is generally hemispherical, with a missing cap. The resulting overall structure, a truncated hollow hemisphere, takes the shape of an annulus, with a diameter that decreases from the base 105 to the open end opposite the base 105.

The elements are antenna element assemblies. The elements are mounted to an underlying support structure 140. The support structure provides sufficient surface area and apertures to enable attachment of each antenna element in the array and connection to a cable (e.g., a coaxial cable). The support structure is shaped in the desired configuration, in this case a truncated hollow hemisphere. Mounting may be accomplished with any suitable means, such as mechanical fasteners (e.g., bolts or screws and nuts or threaded engagement holes). When mounted to the underlying support structure 140, the array of elements generally takes the truncated hemispherical shape. The exemplary base 105 includes various apertures, such as mounting holes 145 and holes for wiring 150.

In the exemplary embodiment, each row includes 64 evenly spaced elements, with each antenna element having the same width. Each antenna element in row 1 is denoted as element 115. Each antenna element in row 2 is denoted as element 125. Each antenna element in row 3 is denoted as element 135. In the exemplary embodiment, elements in rows 2 and 3 are the same. They are interchangeable. However, elements 115 in row 1 are different from elements in rows 2 and 3. The differences, as discussed below, enable the array to overcome problems described above, to which the array described in Chandler et al. is vulnerable.

The shape of the array, number of elements and spacing determine the array size. Each row includes 64 antenna elements. Each antenna element in the exemplary embodiment has the same width. The width of an element 115 in row 1, is the same as the width of an element 125 in row 2, which is the same as the width of an element in row 3, in the exemplary embodiment. The diameter of a row varies from the bottom end of an element to the top end of an element. The average diameter of each row differs from the average diameter of each other row. Thus, the spacing between each successive element in row 1, which is the row with the greatest average diameter, is greater than the spacing between each successive element in row 2. Likewise, the spacing between each successive element in row 2, which has a greater average diameter than that of row 3, is greater than the spacing between each successive element in row 3.

Figure 3:
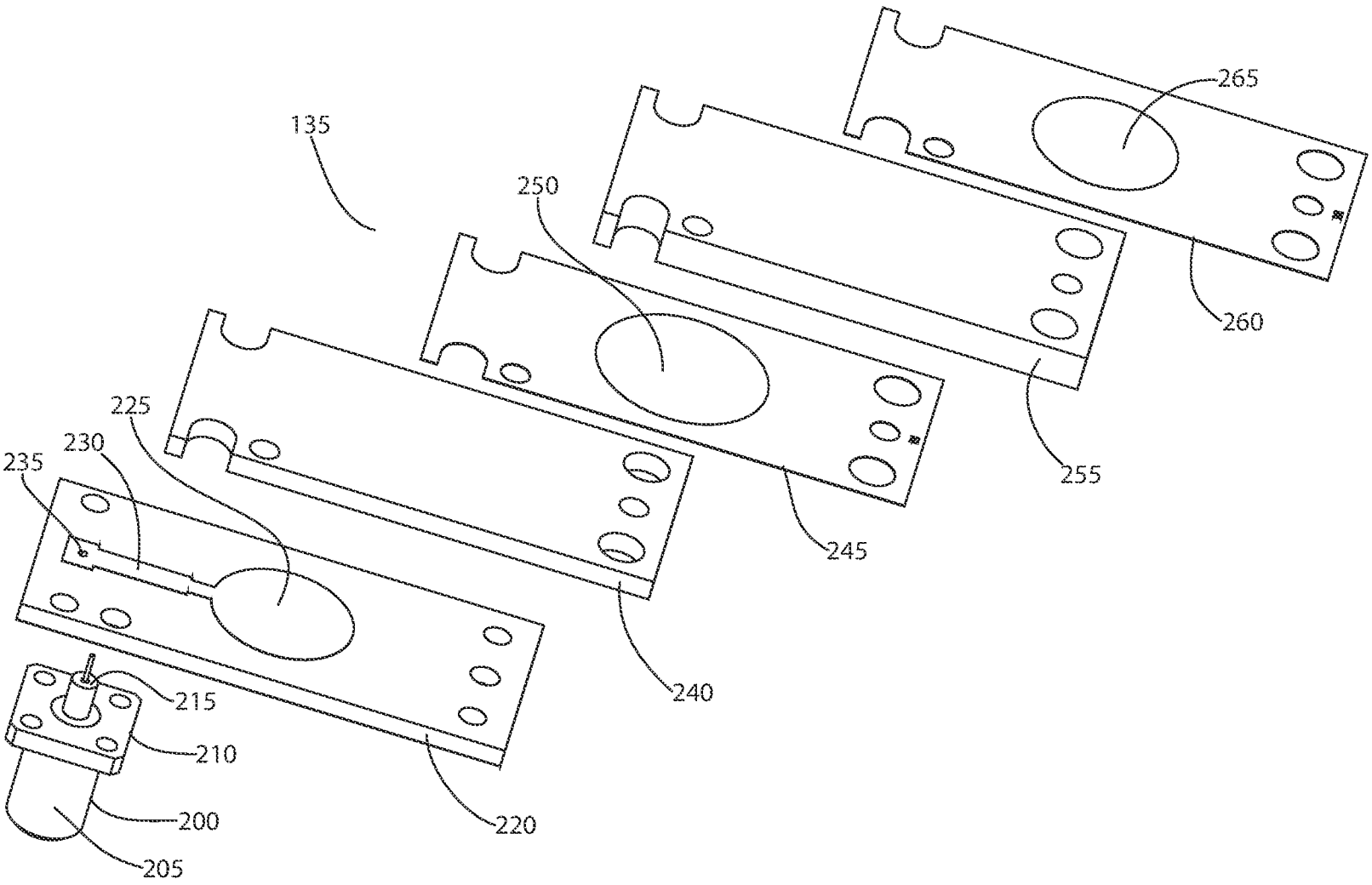
FIG. 3 is an exploded view of an antenna element assembly for top and middle levels of the exemplary hemispherical array according to principles of the invention.

FIG. 3 conceptually illustrates components of an element 125 (i.e., element assembly) for rows 2 and 3 of the exemplary array 100. A connector 200 is provided for coupling a transmission line for radio frequency signals. In an exemplary embodiment, the transmission line is coaxial cable, and the connector 200 is an SMA (SubMiniature version A) connector. The connector 200 includes an internally threaded sleeve 205 for mating with a male coupling on the end of a coaxial cable. A mounting flange 210 is provided for attachment to a substrate, such as printed circuit board 220. A copper core 215, as in a coaxial cable, which is surrounded by a dielectric insulator, woven copper shield and an outer plastic sheath extends from the flange 210. The core 215 extends through a hole 235 in the printed circuit board 220 to trace 230.

Figure 5:
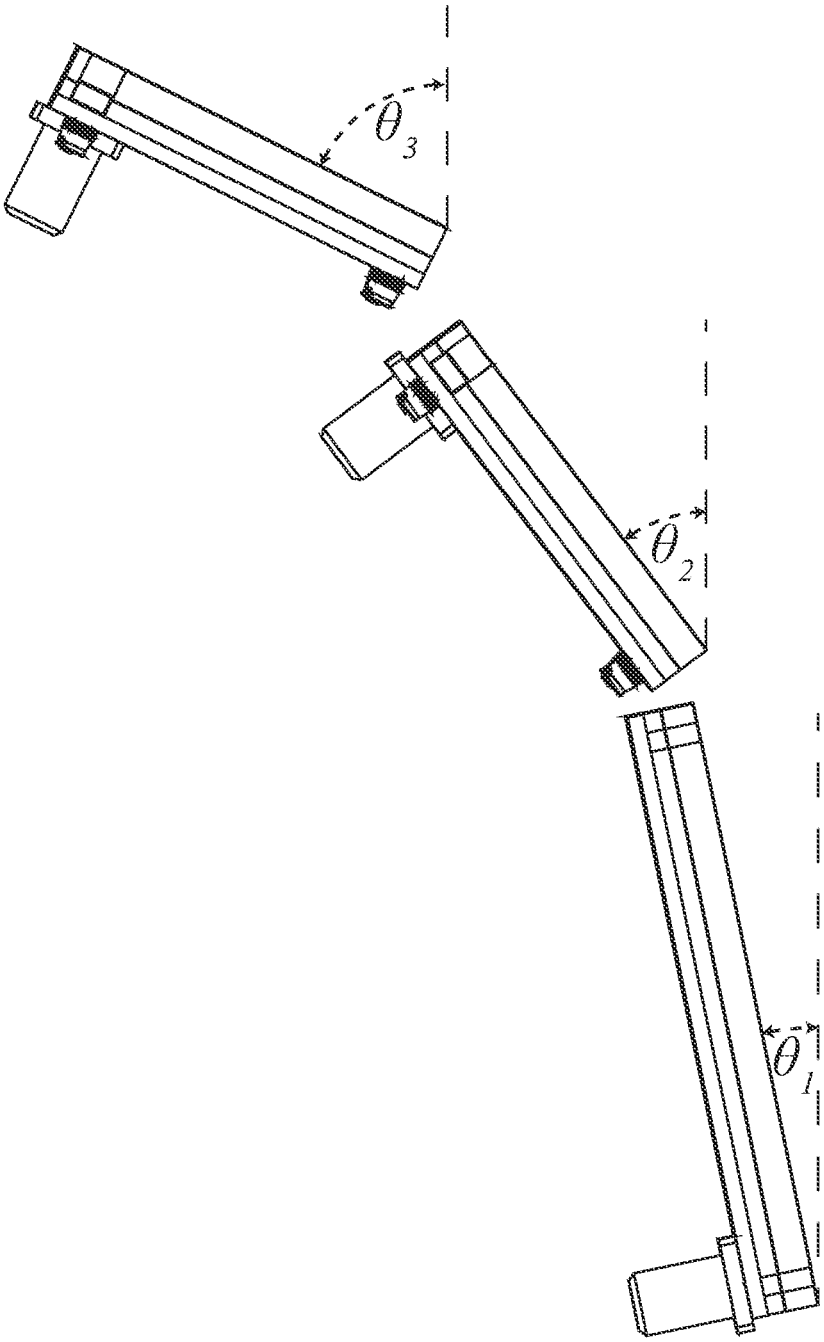
FIG. 5 is a profile view of aligned antenna element assemblies for top, middle and bottom levels of the exemplary hemispherical array, illustrating elevation angles, according to principles of the invention.

An individual microstrip antenna 225 is provided on the printed circuit board 220. The microstrip antenna 225 consists of a circular patch of copper foil, with a metal foil ground plane on the other side of the printed circuit board 220. The circular patch, which is designed to operate at X-band, is compact, avoids edge effects and achieves high gain. The patch is connected to the transmitter/receiver through a foil microstrip transmission line, i.e., trace 230, and through the connection with the core 215 of the SMA connector 200. The diameter of the exemplary circular patch is 1 to 1.5 cm, preferably about 1.20 cm, and more preferably 1.204 cm (0.47 in.). The width of the printed circuit board 220 is about 1.867 cm (0.725 in.) as shown in FIG. 5. The length of the printed circuit board 220 is about 4.064 cm (1.6 in), as also shown in FIG. 5. The thickness of the printed circuit board 220 is about 1.6 mm (0.062 in.).

A pair of dielectric spacers 240, 255 are provided to separate parasitic directors 250, 265 from each other and from the driven patch 225. One dielectric spacer 240 covers the printed circuit board 220. The other dielectric spacer 255 covers the director 250. Each spacer 240, 255 is comprised of a closed-cell rigid foam, such as a foam composed of polymethacrylimide (PMI) that exhibits a low dielectric constant and excellent transmission properties at high frequencies. Each spacer 240, 255 is about 0.125 in. thick.

A pair of parasitic directors 250, 265 is provided for each element in rows 2 and 3. Each parasitic director 250, 265 is formed on a printed circuit board 245, 260. Each printed circuit board 245, 260 overlays a spacer 240, 255. Each parasitic director 250, 265 is aligned with the driven circular patch 225. Each parasitic director 250, 265 is a circular patch of copper foil, with a diameter equal to the diameter of the driven patch 225. Each parasitic director 250, 265 modifies the radiation pattern of the radio waves emitted by the driven patch 225, directing radio waves in a beam in one direction and increasing the antenna's directivity (gain). Each parasitic director 250, 265 does this by acting as a passive resonator, absorbing the radio waves from the driven patch 225 and re-radiating the radio waves with a different phase. The waves from the different antenna elements (patch 225, director 250 and director 265) interfere, strengthening the antenna's radiation in the desired direction, and canceling out waves in undesired directions. The patch 225 and directors 250, 265 are arranged in a line that is perpendicular to the direction of radiation of the antenna element assembly 125.

The layers 220, 240, 245, 255 and 260 of the element are fastened together. Mechanical fasteners, such as screws or bolts may extend from one side of the assembly, through mounting holes in the layers, and engage nuts on the opposite side.

Figure 4:
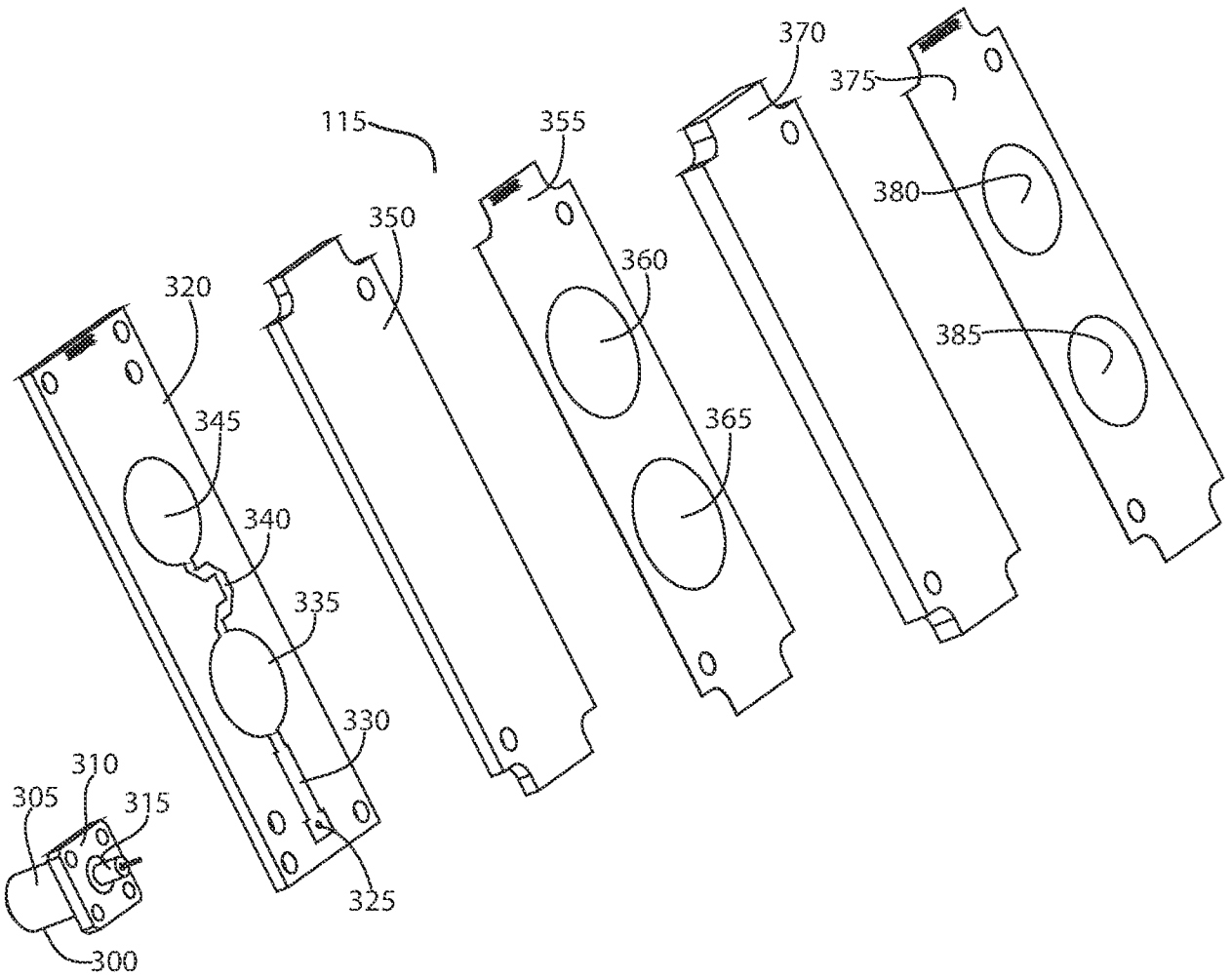
FIG. 4 is an exploded view of an antenna element assembly for a bottom level of the exemplary hemispherical array according to principles of the invention.

FIG. 4 conceptually illustrates components of an element 115 (i.e., element assembly) for row 1 of the exemplary array 100. This element 115 differs from the elements 125, 135 for rows 2 and 3 because it includes a pair of driven patches coupled by a phase delay line, and also includes two pairs of spaced apart parasitic directors.

Connector 300, which is the same as connector 200, couples the element 115 to a transmission line for radio frequency signals. In an exemplary embodiment, the transmission line is coaxial cable, and the connector 300 is an SMA (SubMiniature version A) connector. The connector 300 includes an internally threaded sleeve 305 for mating with a male coupling on the end of a coaxial cable. A mounting flange 310 is provided for attachment to a substrate, such as printed circuit board 320. A copper core 315, as in a coaxial cable, which is surrounded by a dielectric insulator, woven copper shield and an outer plastic sheath extends from the flange 310. The core 315 extends through a hole 325 in the printed circuit board 320 to trace 330.

A pair of microstrip antennas 335, 345 is provided on the printed circuit board 320. The microstrip antennas 335 consist of circular patches of copper foil, each having a metal foil ground plane on the other side of the printed circuit board 320. Each circular patch, which is designed to operate at X-band, is compact, avoids edge effects and achieves high gain. One patch 335 is connected to the transmitter/receiver through a foil microstrip transmission line, i.e., trace 330, and through the connection with the core 315 of the SMA connector 300. The other patch 345 is connected to the first patch 335 by phase delay line 340 of a determined length, the length being greater than the distance between the patches. In an exemplary embodiment, the length of the phase delay line 340 is about one half of a wavelength of a wave radiated from each patch 335, 345. The diameter of the exemplary circular patch is 1 to 1.5 cm, preferably about 1.20 cm, and more preferably 1.204 cm (0.47 in.). The width of the printed circuit board 220 is about 1.867 cm (0.725 in.) as shown in FIG. 5. The length of the printed circuit board 220 is about 4.064 cm (1.6 in), as also shown in FIG. 5. The thickness of the printed circuit board 220 is about 1.6 mm (0.062 in.).

Dielectric spacers 350, 370 are provided to separate pairs of parasitic directors 360, 365 and 380, 385 from each other and from the driven patches 335, 345. One dielectric spacer 350 covers the printed circuit board 320. The other dielectric spacer 370 covers the pair of directors 360, 365 closest to the driven patches 335, 345. Each spacer 350, 370 is comprised of a closed-cell rigid foam, such as a foam composed of polymethacrylimide (PMI) that exhibits a low dielectric constant and excellent transmission properties at high frequencies. Each spacer 350, 370 is about 0.125 in. thick.

Two pairs of parasitic directors 360, 365 and 380, 385 are provided. Each pair of parasitic directors 360, 365 and 380, 385 is formed on a printed circuit board 355, 375. Each printed circuit board 355, 375 overlays a spacer 350, 370. Each parasitic director 360, 365 and 380, 385 is aligned with one of the driven circular patches 335, 345. Each parasitic director 360, 365 and 380, 385 consists of a circular patch of copper foil, with a diameter equal to the diameter of the driven patches 335, 345. Each parasitic director 360, 365 and 380, 385 modifies the radiation pattern of the radio waves emitted by the driven patch 335, 345, directing radio waves in a beam in one direction, increasing the antenna's directivity (gain). Each parasitic director 360, 365 and 380, 385 does this by acting as a passive resonator, absorbing the radio waves from the driven patch 335, 345 and re-radiating the radio waves with a different phase. The waves from the different antenna elements (from or to patch 335, director 365 and director 385 and from or to patch 345, director 360 and director 380) interfere, strengthening the antenna's radiation in the desired direction, and canceling out waves in undesired directions. Each patch 335, 345 and its associated directors 360, 365 and 380, 385 are arranged in a line perpendicular to the direction of radiation of the antenna element assembly 115.

The layers 320, 350, 355, 370 and 375 of the element are fastened together. Mechanical fasteners, such as screws or bolts may extend from one side of the assembly, through mounting holes in the layers, and engage nuts on the opposite side.

Thus, in the exemplary embodiment, each antenna element of rows 2 and 3 includes a single driven patch. Each antenna element of row 1 includes a pair of driven patches coupled by a phase delay line. While elements in rows 2 and 3 may function with such a pair of driven patches, more than one driven patch is not needed for such elements. A single driven patch will suffice for each element in rows 2 and 3.

Figure 6:
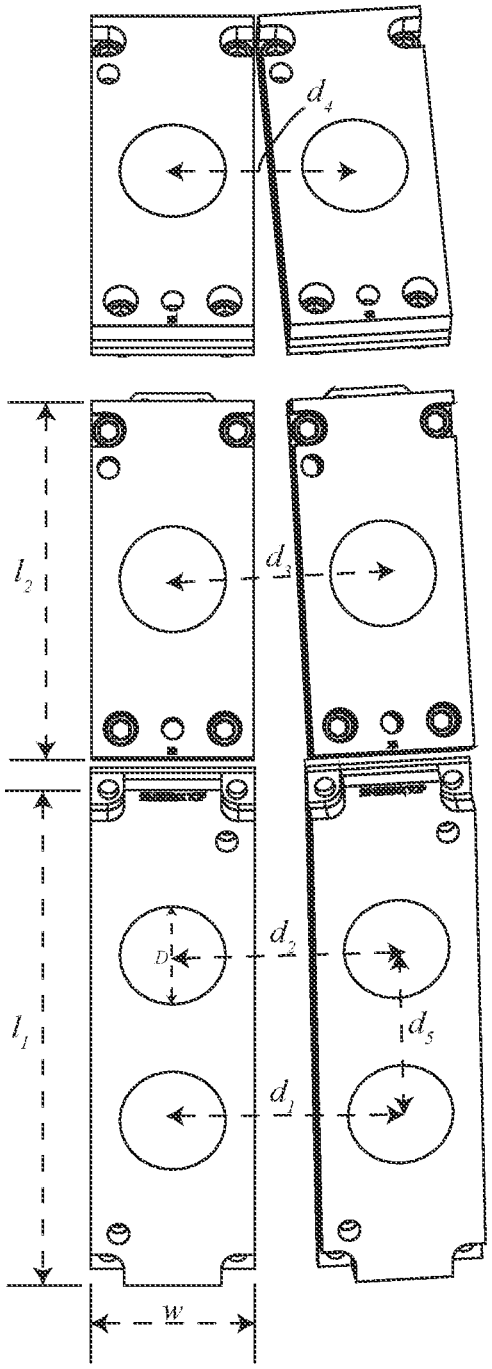
FIG. 6 is a front view of aligned antenna element assemblies for top, middle and bottom levels of the exemplary hemispherical array, illustrating side by side spacing, according to principles of the invention.

FIGS. 5 and 6 provide exemplary dimensions. In FIG. 5, an elevation angle (0) is conceptually illustrated for each row. The elevation angle is the angle of the planar surface of the element relative to vertical, assuming the base 105 of the array 100 is horizontal. If the base is not horizontal, then the elevation angle may be measured relative to an imaginary line extending normal to the base 105. The elevation angle varies to conform generally to the shape of a hemisphere. The elevation angle for row 1 is the smallest elevation angle. The elevation angle increases in each successive row. Thus, the angle for row two is greater than that of row 1, and the angle for row 3 is greater than that for row 2. As an example, an approximate elevation for row 1, row 2 and row 3 is 10°, 35° and 60°, respectively.

The exemplary array 100 according to principles of the invention includes 64 elements per row. The spacing between adjacent elements in the same row, which may be measured from center to center of each adjacent pair of circular parasitic directors, is about one half of a wavelength (½λ) for a radiated wave. As each of the parasitic directors is aligned with its driven patch of the same diameter, the spacing between adjacent driven patches is the same as the distance between adjacent parasitic directors. X-band frequencies range from 8-12 GHz and have wavelengths from 7.5-3.75 cm. The wavelength A may be computed from the frequency v and the speed of light c, an assumption being that the wave is traveling at the speed of light, which is the case for most wireless signals:

$$\lambda = \frac{c}{v}$$

Nonlimiting examples of values for $d_1$, $d_2$, $d_3$ and $d_4$ are 2.60, 2.55, 2.40 and 2.08 cm, respectively. The diameter of each circular parasitic director is about 1.20 cm. The width, w, of each antenna element is about 1.87 cm. The length, l, of each row 1 element is about 6.10 cm, and of each row 2 and row 3 element is about 4.06 cm. The distance between the parasitic directors of a single row 3 element, measured from center to center is about 1.98 cm.

These dimensions, the spacing between adjacent elements and the hemispherical shape define the size of the array. In the exemplary embodiment, the diameter of the array 100 is less than 24 inches. Such a size fits within a commercially available marine radome. Such a size is compact, but large enough to facilitate assembly. A substantially smaller array could unnecessarily complicate assembly.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A multibeam hemispherical array configured to insert nulls at horizontal and near horizontal angles to suppress interfering signals, without degrading authentic signals arriving at other angles, the multibeam hemispherical array comprising:

three annular rows of antenna elements, each annular row comprising a constant latitude of antenna elements, and each annular row of the three annular rows being parallel to each other annular row of the three annular rows, and the three annular rows including a first row, a second row and a third row, the second row being disposed between the first row and the third row, and the first row having a first diameter, the second row having a second diameter, the third row having a third diameter, the first diameter being greater than the second diameter, and the second diameter being greater than the third diameter; and each antenna element of the second row and the third row including a single driven circular patch;

and each antenna element of the first row including a pair of driven circular patches, and each patch of the pair of driven circular patches having a determined diameter.

2. The multibeam hemispherical array of claim 1, the single driven circular patch of each antenna element of the second row being spaced apart from each adjacent single driven circular patch of each adjacent antenna element of the second row by a distance of about one half of a wavelength of a wave radiated from the single driven circular patch, said distance being measured from a center of each single driven circular patch to a center of each adjacent single driven circular patch.

3. The multibeam hemispherical array of claim 1, the single driven circular patch of each antenna element of the third row being spaced apart from each adjacent single driven circular patch of each adjacent antenna element of the third row by a distance of about one half of a wavelength of a wave radiated from the single driven circular patch, said distance being measured from a center of each single driven circular patch to a center of each adjacent single driven circular patch.

4. The multibeam hemispherical array of claim 1, the diameter of each single driven circular patch of each antenna element of the second row and the third row and the diameter of each driven circular patch of the pair of driven circular patches of each antenna element of the first row being 1 to 1.5 cm.

5. The multibeam hemispherical array of claim 1, the diameter of each single driven circular patch of each antenna element of the second row and the third row and the diameter of each driven circular patch of the pair of driven circular patches of each antenna element of the first row being about 1.20 cm.

6. The multibeam hemispherical array of claim 1, further comprising a phase delay line coupling the pair of driven circular patches of each antenna element of the first row.

7. The multibeam hemispherical array of claim 6, the pair of driven circular patches being separated by a separation distance that is less than one half of a wavelength of a wave radiated from each patch of the pair of driven circular patches.

8. The multibeam hemispherical array of claim 6, the phase delay line having a length that is about equal to one half of a wavelength of a wave radiated from each patch of the pair of driven circular patches.

9. The multibeam hemispherical array of claim 1, the elevation angle of each antenna element of the first row being about 10 degrees, and the elevation angle of each antenna element of the second row being about 35 degrees, and the elevation angle of each antenna element of the third row being about 60 degrees.

10. The multibeam hemispherical array of claim 1, each row of the first row, the second row and the third row containing 64 antenna elements.

11. The multibeam hemispherical array of claim 10, the 64 antenna elements of each of the first row, the second row and the third row being evenly spaced.

12. The multibeam hemispherical array of claim 1, each antenna element of the second row and the third row further including an intermediate circular parasitic director spaced apart from and aligned with the single driven circular patch; and each antenna element of the first row further including an intermediate pair of circular parasitic directors spaced apart from and aligned with the pair of driven circular patches.

13. The multibeam hemispherical array of claim 12, further comprising an intermediate spacer disposed between the intermediate circular parasitic director and the single driven circular patch, the intermediate spacer comprising a dielectric closed cell foam; and an outer spacer disposed between the intermediate pair of circular parasitic directors and the pair of driven circular patches, the outer spacer comprising a dielectric closed cell foam.

14. The multibeam hemispherical array of claim 13, each antenna element of the second row and the third row further including an outer circular parasitic director spaced apart from and aligned with the single driven circular patch, the intermediate circular parasitic director being disposed between the single driven circular patch and the outer circular parasitic director; and each antenna element of the first row further including an outer pair of circular parasitic directors spaced apart from and aligned with the pair of driven circular patches, the intermediate pair of circular parasitic directors being disposed between the pair of driven circular patches and the outer pair of circular parasitic directors.

15. The multibeam hemispherical array of claim 14, further comprising an outer spacer disposed between the intermediate circular parasitic director and the outer circular parasitic director, the third spacer comprising a dielectric closed cell foam; and an outer spacer disposed between the intermediate pair of circular parasitic directors and the outer pair of circular parasitic directors, the outer spacer comprising a dielectric closed cell foam.

16. The multibeam hemispherical array of claim 15, a thickness of each spacer being about ⅛ inch.

17. The multibeam hemispherical array of claim 1, the single driven circular patch of each antenna element of the second row being spaced apart from each adjacent single driven circular patch of each adjacent antenna element of the second row by a distance of about one half of a wavelength of a wave radiated from the single driven circular patch, said distance being measured from a center of each single driven circular patch to a center of each adjacent single driven circular patch; and the single driven circular patch of each antenna element of the second row being spaced apart from each adjacent single driven circular patch of each adjacent antenna element of the second row by a distance of about one half of a wavelength of a wave radiated from the single driven circular patch, said distance being measured from a center of each single driven circular patch to a center of each adjacent single driven circular patch; and the diameter of each single driven circular patch of each antenna element of the second row and the third row and the diameter of each driven circular patch of the pair of driven circular patches of each antenna element of the first row being 1 to 1.5 cm.

18. The multibeam hemispherical array of claim 17, further comprising a phase delay line coupling the pair of driven circular patches of each antenna element of the first row, the pair of driven circular patches being separated by a separation distance that is less than one half of a wavelength of a wave radiated from each patch of the pair of driven circular patches, and the phase delay line having a length that is greater than the separation distance.

19. The multibeam hemispherical array of claim 18, each row of the first row, the second row and the third row containing 64 antenna elements, and the 64 antenna elements of each of the first row, the second row and the third row being evenly spaced.

20. The multibeam hemispherical array of claim 19, each antenna element of the second row and the third row further including a first circular parasitic director spaced apart from and aligned with the single driven circular patch; and each antenna element of the first row further including a first pair of circular parasitic directors spaced apart from and aligned with the pair of driven circular patches; and a first spacer disposed between the first circular parasitic director and the single driven circular patch, the first spacer comprising a dielectric closed cell foam; and a second spacer disposed between the first pair of circular parasitic directors and the pair of driven circular patches, the second spacer comprising a dielectric closed cell foam; and a thickness of the first spacer and of the second spacer being about ⅛ inch; and each antenna element of the second row and the third row further including a second circular parasitic director spaced apart from and aligned with the single driven circular patch, the first circular parasitic director being disposed between the single driven circular patch and the second circular parasitic director; and each antenna element of the first row further including a second pair of circular parasitic directors spaced apart from and aligned with the pair of driven circular patches, the first pair of circular parasitic directors being disposed between the pair of driven circular patches and the second pair of circular parasitic directors; and a third spacer disposed between the first circular parasitic director and the second circular parasitic director, the third spacer comprising a dielectric closed cell foam; and a fourth spacer disposed between the first pair of circular parasitic directors and the second pair of circular parasitic directors, the fourth spacer comprising a dielectric closed cell foam; and a thickness of the third spacer and of the fourth spacer being about ⅛ inch.

* * * * *